US009020392B2

(12) United States Patent
Hashimoto

(10) Patent No.: US 9,020,392 B2
(45) Date of Patent: Apr. 28, 2015

(54) IMAGE FORMING APPARATUS PROVIDED WITH CARTRIDGE SUPPORT UNIT

(71) Applicant: Junichi Hashimoto, Toyohashi (JP)

(72) Inventor: Junichi Hashimoto, Toyohashi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/951,983

(22) Filed: Jul. 26, 2013

(65) Prior Publication Data

US 2014/0037329 A1 Feb. 6, 2014

(30) Foreign Application Priority Data

Jul. 31, 2012 (JP) ..... 2012-169824

(51) Int. Cl.
*G03G 15/00* (2006.01)
*G03G 21/16* (2006.01)
*G03G 15/01* (2006.01)

(52) U.S. Cl.
CPC ..... *G03G 21/1647* (2013.01); *G03G 15/0194* (2013.01); *G03G 21/1619* (2013.01)

(58) Field of Classification Search
CPC ..... G03G 21/1647
USPC ..... 399/110
See application file for complete search history.

(56) References Cited

U.S. PATENT DOCUMENTS

| | | | | |
|---|---|---|---|---|
| 7,826,766 | B2 | 11/2010 | Okabe | |
| 2008/0181658 | A1 | 7/2008 | Okabe | |
| 2009/0179973 | A1* | 7/2009 | Yokouchi | 347/85 |
| 2010/0247138 | A1* | 9/2010 | Kikuchi et al. | 399/110 |
| 2011/0211865 | A1* | 9/2011 | Hashimoto et al. | 399/119 |
| 2012/0195628 | A1* | 8/2012 | Kato | 399/110 |
| 2012/0308265 | A1* | 12/2012 | Hashimoto et al. | 399/167 |
| 2013/0051810 | A1* | 2/2013 | Nakamura et al. | 399/12 |
| 2013/0136491 | A1* | 5/2013 | Fumoto | 399/110 |
| 2013/0230335 | A1* | 9/2013 | Hiura et al. | 399/110 |

FOREIGN PATENT DOCUMENTS

| | | | |
|---|---|---|---|
| JP | 2008-185830 | A | 8/2008 |
| JP | 2010-250287 | A | 11/2010 |

* cited by examiner

*Primary Examiner* — Billy Lactaoen
*Assistant Examiner* — Arlene Heredia Ocasio
(74) *Attorney, Agent, or Firm* — Banner & Witcoff, Ltd.

(57) ABSTRACT

An image forming apparatus includes: a cartridge support unit in which a plurality of cartridges are supported; an abutment portion; and a first applying portion. The cartridge support unit moves in a mounting direction from a withdrawn position to a mounted position. The abutment portion is disposed at one of the main casing and the cartridge support unit. The first applying portion is disposed at the other of the main casing and the cartridge support unit. The first applying portion abuts on the abutment portion to apply a first resistance force in a direction opposite to the mounting direction to the cartridge support unit when the cartridge support unit moves in the mounting direction. The first applying portion and the abutment portion are configured such that the first resistance force continuously increases and then continuously decreases.

19 Claims, 12 Drawing Sheets

IMAGE FORMING APPARATUS PROVIDED WITH CARTRIDGE SUPPORT UNIT

CROSS REFERENCE TO RELATED APPLICATION

This application claims priority from Japanese Patent Application No. 2012-169824 filed Jul. 31, 2012. The entire content of the priority application is incorporated herein by reference.

TECHNICAL FIELD

The present invention relates to an image forming apparatus including a cartridge support unit that supports a plurality of cartridges and that is configured to be withdrawn from a main casing of the image forming apparatus.

BACKGROUND

There is conventionally known an image forming apparatus including a cartridge support unit configured to support a plurality of cartridges and to be mounted in and withdrawn from a main casing. Further, the image forming apparatus is so configured as to prevent the cartridge support unit from being forcibly mounted in the main casing.

More specifically, when the cartridge support unit moves in a mounting direction toward a mounted position inside the main casing, the cartridge support unit is configured to receive a resistance force in a direction opposite to the mounting direction from a resistance force applying portion provided in the main casing by abutting on the resistance force applying portion. The resistance force applied to the cartridge support unit by the resistance force applying portion at this time gradually increases, and is then turned into a force pressing the cartridge support unit in the mounting direction.

SUMMARY

However, in the above-described technique, the resistance force suddenly changes into the propulsion force. This causes a user who is mounting the cartridge support unit to have a feeling that something is wrong. As a result, the user may stop moving the cartridge support unit before reaching the proper mounted position, or may push the cartridge support unit into the main casing by force.

In view of the foregoing, it is an object of the present invention to provide an image forming apparatus that enables a user to mount a cartridge support unit in a main casing without making the user feel that something is wrong.

In order to attain the above and other objects, the present invention provides an image forming apparatus including: a main casing; a plurality of cartridges; a cartridge support unit; an abutment portion; and a first applying portion. The cartridge support unit is configured to support the plurality of cartridges. The cartridge support unit is configured to move in a withdrawing direction from a mounted position at which the cartridge support unit is mounted inside the main casing to a withdrawn position positioned outward of the mounted position in the withdrawing direction with respect to the main casing, and to move in a mounting direction from the withdrawn position to the mounted position. The abutment portion is disposed at one of the main casing and the cartridge support unit. The first applying portion is disposed at the other of the main casing and the cartridge support unit. The first applying portion is configured to abut on the abutment portion to apply a first resistance force in a direction opposite to the mounting direction to the cartridge support unit when the cartridge support unit moves in the mounting direction. The first applying portion and the abutment portion are configured such that the first resistance force continuously increases and then continuously decreases when the cartridge support unit moves in the mounting direction.

According to another aspect, the present invention provides an image forming apparatus including: a main casing; a plurality of cartridges; a cartridge support unit; an abutment member; and an applying member. The cartridge support unit is configured to support the plurality of cartridges. The cartridge support unit is configured to move in a withdrawing direction from a mounted position at which the cartridge support unit is mounted inside the main casing to a withdrawn position positioned outward of the mounted position in the withdrawing direction with respect to the main casing, and to move in a mounting direction from the withdrawn position to the mounted position. The abutment member is disposed at one of the main casing and the cartridge support unit. The applying member is disposed at the other of the main casing and the cartridge support unit. The applying member has a first applying portion and a second applying portion. The first applying portion is configured to abut on the abutment member to apply a first resistance force in a direction opposite to the mounting direction to the cartridge support unit when the cartridge support unit moves in the mounting direction. The first applying portion and the abutment member are configured such that the first resistance force continuously increases and then continuously decreases when the cartridge support unit moves in the mounting direction. The second applying portion is configured to abut on the abutment member to apply a second resistance force in a direction opposite to the withdrawing direction to the cartridge support unit when the cartridge support unit moves in the withdrawing direction. The second applying portion and the abutment member are configured such that the second resistance force continuously increases and then continuously decreases when the cartridge support unit moves in the withdrawing direction.

According to still another aspect, the present invention provides an image forming apparatus including: a main casing; a plurality of cartridges; a cartridge support unit; an abutment portion; and a first applying portion. The cartridge support unit is configured to support the plurality of cartridges. The cartridge support unit is configured to move in a withdrawing direction from a mounted position at which the cartridge support unit is mounted inside the main casing to a withdrawn position positioned outward of the mounted position in the withdrawing direction with respect to the main casing, and to move in a mounting direction from the withdrawn position to the mounted position. The abutment portion is disposed at one of the main casing and the cartridge support unit. The first applying portion is disposed at the other of the main casing and the cartridge support unit. The first applying portion has a first curved surface configured to abut on a second curved surface of the abutment portion when the cartridge support unit moves in the mounting direction.

DETAILED DESCRIPTION

A color printer as an image forming apparatus according to one embodiment of the present invention will be described with reference to FIGS. 1 through 9.

Throughout the specification, the terms "upward", "downward", "upper", "lower", "above", "below", "beneath", "right", "left", "front", "rear" and the like will be used assuming that the color printer 1 is disposed in an orientation in which it is intended to be used. More specifically, in FIG. 1 a left side and a right side are a rear side and a front side, respectively. Further, in FIG. 1 a near side and a far side are a left side and a right side, respectively. Further, in FIG. 1 a top side and a bottom side are a top side and a bottom side, respectively.

<Overall Structure of Color Printer>

Figure 1:
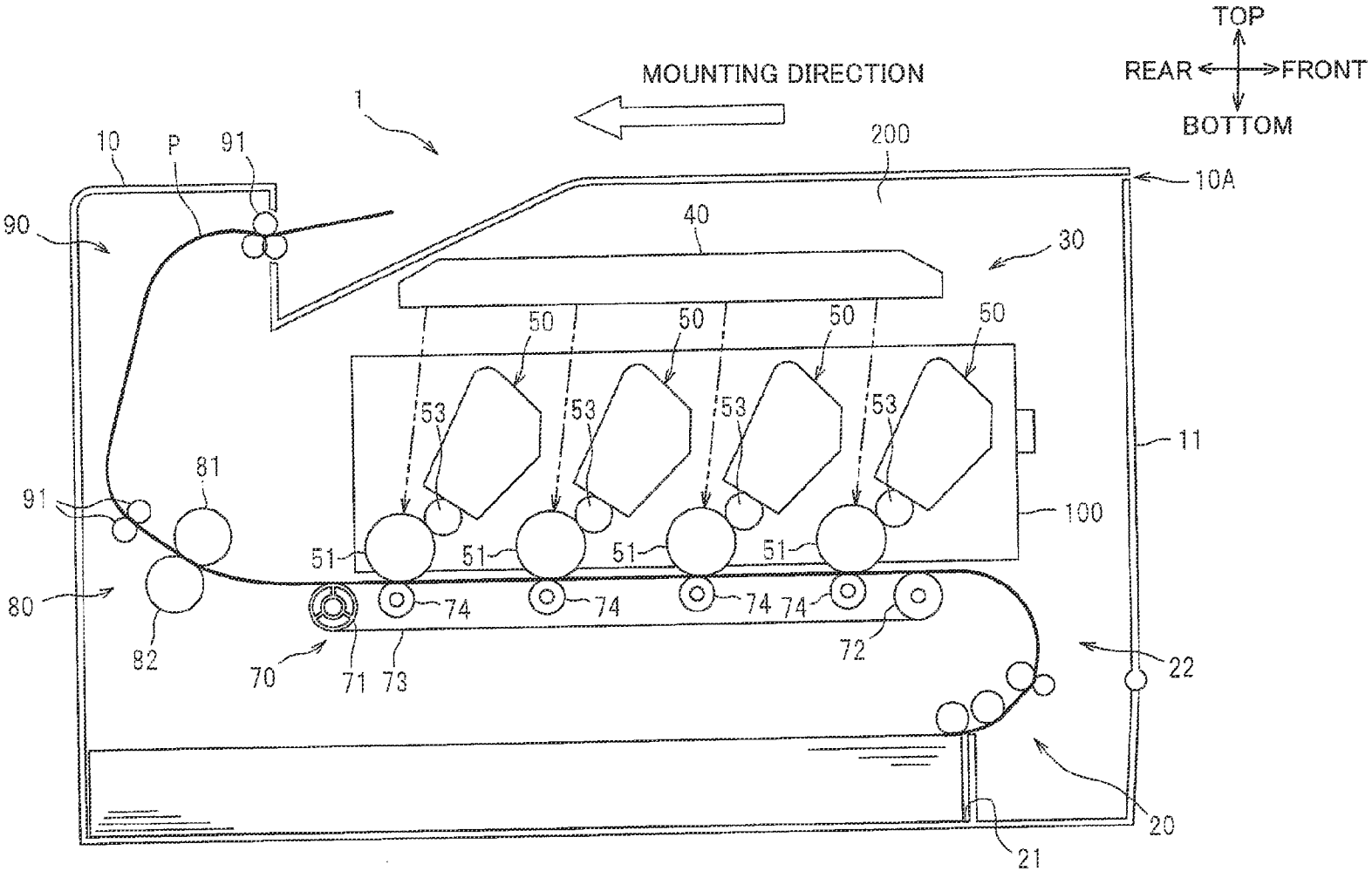
FIG. 1 is a schematic cross-sectional view of a color printer according to one embodiment of the present invention.

Referring to FIG. 1, the color printer 1 includes a main casing 10, and within the main casing 10, further includes a sheet supply unit 20, an image forming unit 30, and a discharge unit 90. The main casing 10 has a front wall at which a front cover 11 is provided. The front cover 11 is movable to open and close an opening 10A (see FIG. 2) formed in the front wall. The sheet supply unit 20 is adapted to supply sheets of paper P to the image forming unit 30. The image forming unit 30 is adapted to form images on the supplied sheets P. The discharge unit 90 is adapted to discharge the sheets P on which the images have been formed.

The sheet supply unit 20 includes a sheet supply tray 21 and a sheet feeding mechanism 22. The sheet supply tray 21 is adapted to accommodate the sheets P therein. The sheet feeding mechanism 22 is adapted to feed the sheets P accommodated in the sheet supply tray 21 toward the image forming unit 30.

The image forming unit 30 includes a scanner unit 40, a plurality of process cartridges 50 (four in the embodiment), a holder 100, a transfer unit 70, and a fixing unit 80.

The scanner unit 40 is disposed at a top portion of the main casing 10, and includes a laser beam emitting portion, a polygon mirror, lenses, and reflection mirrors (which are not illustrated). A laser beam emitted from the scanner unit 40 passes through each path denoted by a chain double-dashed line to be irradiated onto a surface of each photosensitive drum 51 with high-speed scanning.

The process cartridges 50 are arrayed in a front-rear direction and disposed above the sheet supply unit 20. Each process cartridge 50 includes the photosensitive drum 51, a known charger (not shown), a developing roller 53, and a toner chamber (shown without reference numeral).

The holder 100 accommodates the four process cartridges 50 integrally therein. The holder 100 is movable in the front-rear direction, through the opening 10A (see FIG. 2) defined by opening the front cover 11, between a mounted position (i.e. position illustrated in FIG. 1) at which the holder 100 is mounted inside the main casing 10 and a withdrawn position (i.e. position illustrated in FIG. 2) at which the holder 100 is positioned outward of the holder 100 at the mounted position with respect to the main casing 10 in the front-rear direction.

Figure 2:
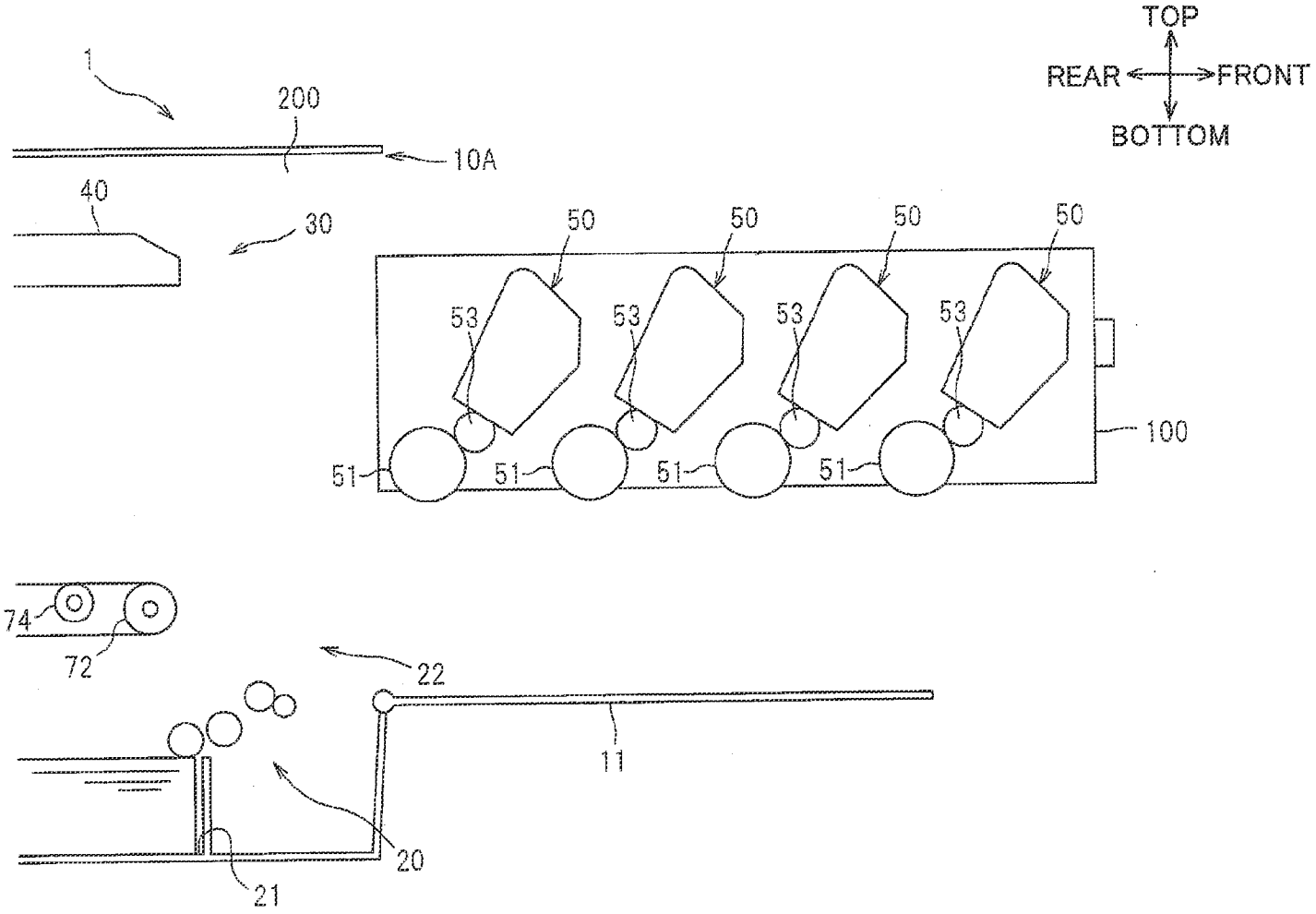
FIG. 2 is a schematic cross-sectional view of the color printer according to the embodiment, showing a state in which a holder of the color printer is at a withdrawn position.

It should be noted that, as shown in FIG. 2, when the holder 100 is at the withdrawn position, the holder 100 is entirely detached from the main casing 10. However, the holder 100 may be still partly attached to the main casing 10 when the holder 100 is at the withdrawn position.

Incidentally, the structure of the holder 100 will be described later in detail. In the following description, a direction in which the holder 100 moves from the withdrawn position to the mounted position (i.e. a direction from front to rear) will be referred to as a mounting direction, and a direction in which the holder 100 moves from the mounted position to the withdrawn position (i.e. a direction from rear to front) will be referred to as a withdrawing direction.

The transfer unit 70 is disposed above the sheet supply unit 20 and below the four process cartridges 50. The transfer unit 70 includes a drive roller 71, a driven roller 72, a conveyor belt 73, and a plurality of transfer rollers 74 (four in the embodiment).

The drive roller 71 and the driven roller 72 are arranged parallel to each other and are spaced apart from each other in the front-rear direction. The conveyor belt 73 is formed of an endless belt and is looped around the drive roller 71 and the driven roller 72. Each of the four transfer rollers 74 is disposed inside the conveyor belt 73, and also disposed in confrontation with the corresponding photosensitive drum 51, with an upper portion of the conveyor belt 73 interposed therebetween. A transfer bias is applied to each transfer roller 74 by constant current control during a transfer operation.

The fixing unit 80 is disposed rearward of the four process cartridges 50 and the transfer unit 70. The fixing unit 80 includes a heat roller 81 and a pressure roller 82. The pressure roller 82 is disposed in confrontation with the heat roller 81 and applies pressure thereto.

In the image forming unit 30 configured as described above, the charger applies a uniform charge to the surface of the corresponding photosensitive drum 51. Subsequently, the photosensitive drum 51 is exposed to the laser beam emitted from the scanner unit 40. Accordingly, an electric potential of the exposed area lowers, so that an electrostatic latent image based on image data is formed on the photosensitive drum 51. After the developing roller 53 supplies toner accommodated in the toner chamber to the electrostatic latent image on the photosensitive drum 51, a visible toner image corresponding to the electrostatic latent image is formed on the photosensitive drum 51.

While the sheet P supplied onto the conveyor belt 73 passes through positions between the respective photosensitive drums 51 and the respective transfer rollers 74, a toner image formed on each photosensitive drum 51 is transferred onto the sheet P. Then, as the sheet P onto which the toner images have been transferred passes between the heat roller 81 and the pressure roller 82, the toner images are thermally fixed onto the sheet P.

The discharge unit 90 includes a plurality of conveyance rollers 91 for conveying the sheet P. The sheet P onto which the toner images have been thermally fixed is conveyed by the conveyance rollers 91 to be discharged outside the main casing 10.

<Structures of Holder and its Peripheral Parts>

Next, the holder 100 will be described in detail.

Figure 3:
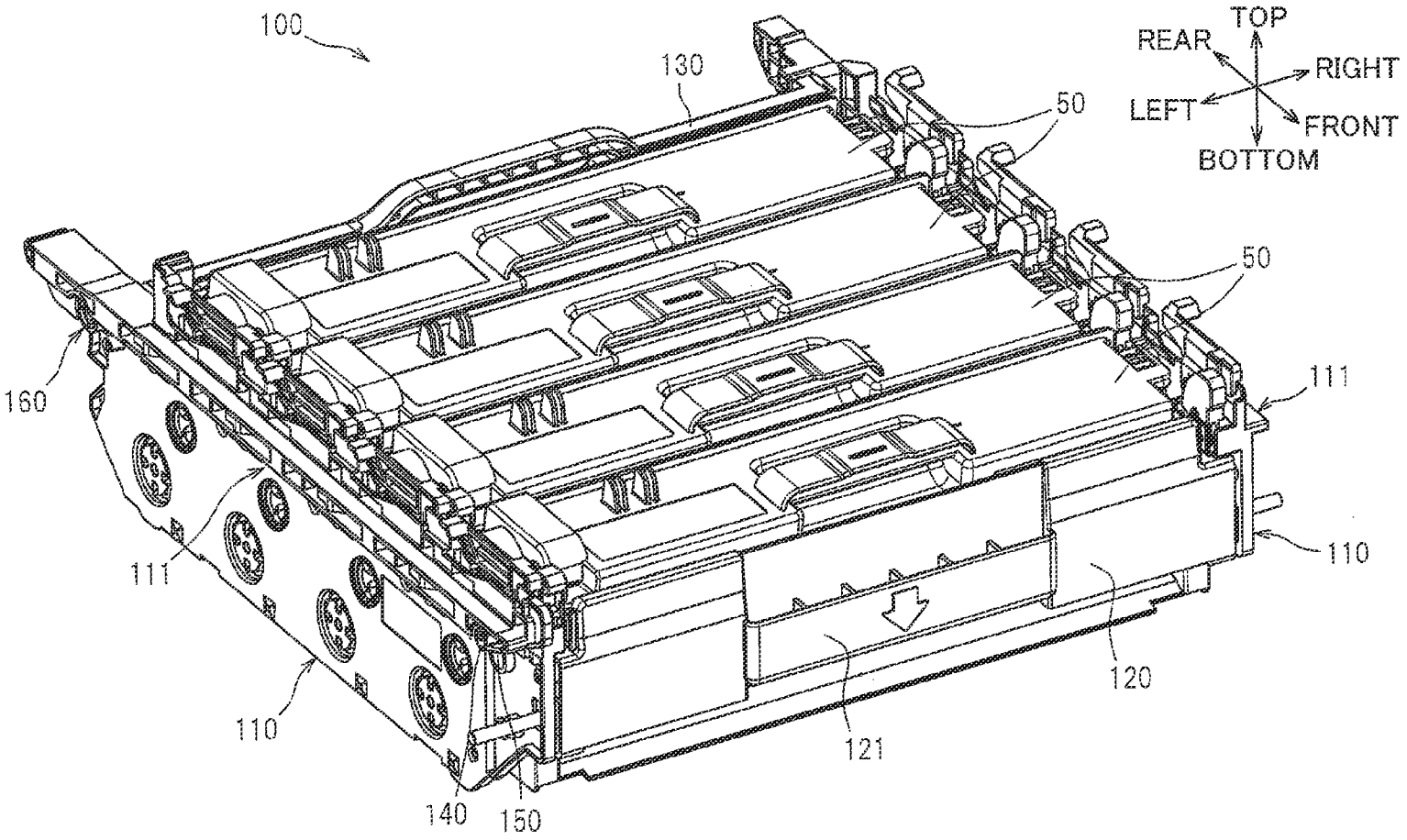
FIG. 3 is a perspective view of the holder of the color printer according to the embodiment.

As shown in FIG. 3, the holder 100 includes a left and right pair of side walls 110, a front beam 120, and a rear beam 130.

The holder 100 is formed in a generally rectangular frame-like shape such that the front beam 120 bridges front end portions of the left and right side walls 110 and the rear beam 130 bridges rear end portions of the left and right side walls 110. Within the holder 100, the four process cartridges 50 are detachably mounted.

The holder 100 is provided with a grip portion 121. The grip portion 121 is provided at the front beam 120 to enable a user to withdraw the holder 100 from the main casing 10.

The pair of side walls 110 is made of resin. Each of the side walls 110 extends in an arrayed direction in which the four process cartridges 50 are arrayed (i.e. front-rear direction), and has an upper end portion at which a flange portion 111 is provided. The flange portion 111 protrudes outward in a left-right direction and extends in the front-rear direction across the entire front-rear length of the side wall 110. The flange portion 111 has a lower surface extending substantially horizontally in the front-rear direction.

Further, each of the side walls 110 has a front end portion provided with an urging portion 140 and a guide portion 150, and a rear end portion provided with a guide roller 160. That is, the urging portion 140 and the guide portion 150 are disposed at an upstream end portion of the side wall 110 in the mounting direction, and the guide roller 160 is disposed at a downstream end portion of the side wall 110 in the mounting direction.

Figure 4:
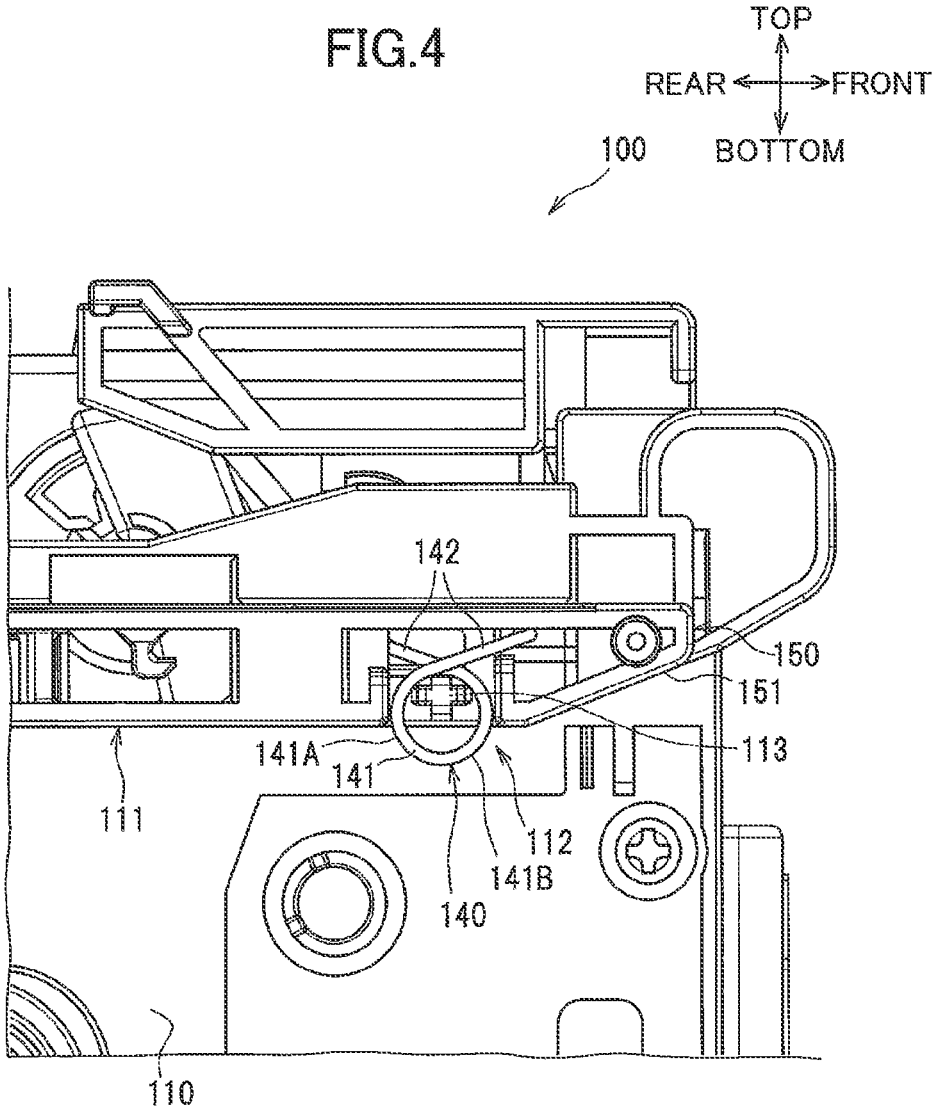
FIG. 4 is a partial enlarged view of the holder of the color printer according to the embodiment, particularly showing structures of an urging portion and its peripheral parts provided in the holder.

More specifically, as shown in FIG. 4, the flange portion 111 has a front end portion provided with a retaining portion 112 whose lower edge is depressed upward. The retaining portion 112 defines an internal space in which the urging portion 140 is accommodated. The retaining portion 112 is provided with a coil support portion 113.

The urging portion 140 applies, to the holder 100, a mounting resistance force in a direction opposite to the mounting direction of the holder 100 when the holder 100 is mounted in the main casing 10. The urging portion 140 also applies, to the holder 100, a withdrawing resistance force in a direction opposite to the withdrawing direction of the holder 100 when the holder 100 is withdrawn from the main casing 10.

The urging portion 140 is configured of a torsion coil spring (resilient member) including a coil portion 141 and an arm portion 142. The coil portion 141 is supported to the coil support portion 113, and has a lower half portion exposed to an outside below the retaining portion 112. Further, the coil portion 141 is disposed inward of an outer surface of the flange portion 111 in the left-right direction.

The arm portion 142 includes two arm segments, one of the arm segments extending diagonally above and frontward from an upper end of the coil portion 141 and a remaining one of the arm segments extending diagonally above and rearward from the upper end of the coil portion 141. Each arm segment has an upper end contacting an upper surface of the retaining portion 112.

With this configuration, when the lower half portion of the coil portion 141 exposed to an outside from the retaining portion 112 is pressed upward, the urging portion 140 is resiliently deformed to retract upward into the retaining portion 112.

The lower half portion of the coil portion 141 exposed to the outside from the retaining portion 112 has an outer peripheral surface, of which a surface facing diagonally below and rearward serves as a first curved surface 141A and a surface facing diagonally below and frontward serves as a third curved surface 141B (see FIG. 4). The first curved surface 141A is abuttable on a guide roller 220 (see FIG. 5, described later) of the main casing 10 from an upstream side of the guide roller 220 in the mounting direction when the holder 100 moves in the mounting direction. Further, the third curved surface 141B is abuttable on the guide roller 220 from an upstream side of the guide roller 220 in the withdrawing direction when the holder 100 moves in the withdrawing direction.

The guide portion 150 is disposed frontward of the retaining portion 112 of the flange portion 111. The guide portion 150 has a guide surface 151 extending diagonally above and frontward from a front end of the lower surface of the flange portion 111.

Figure 5:
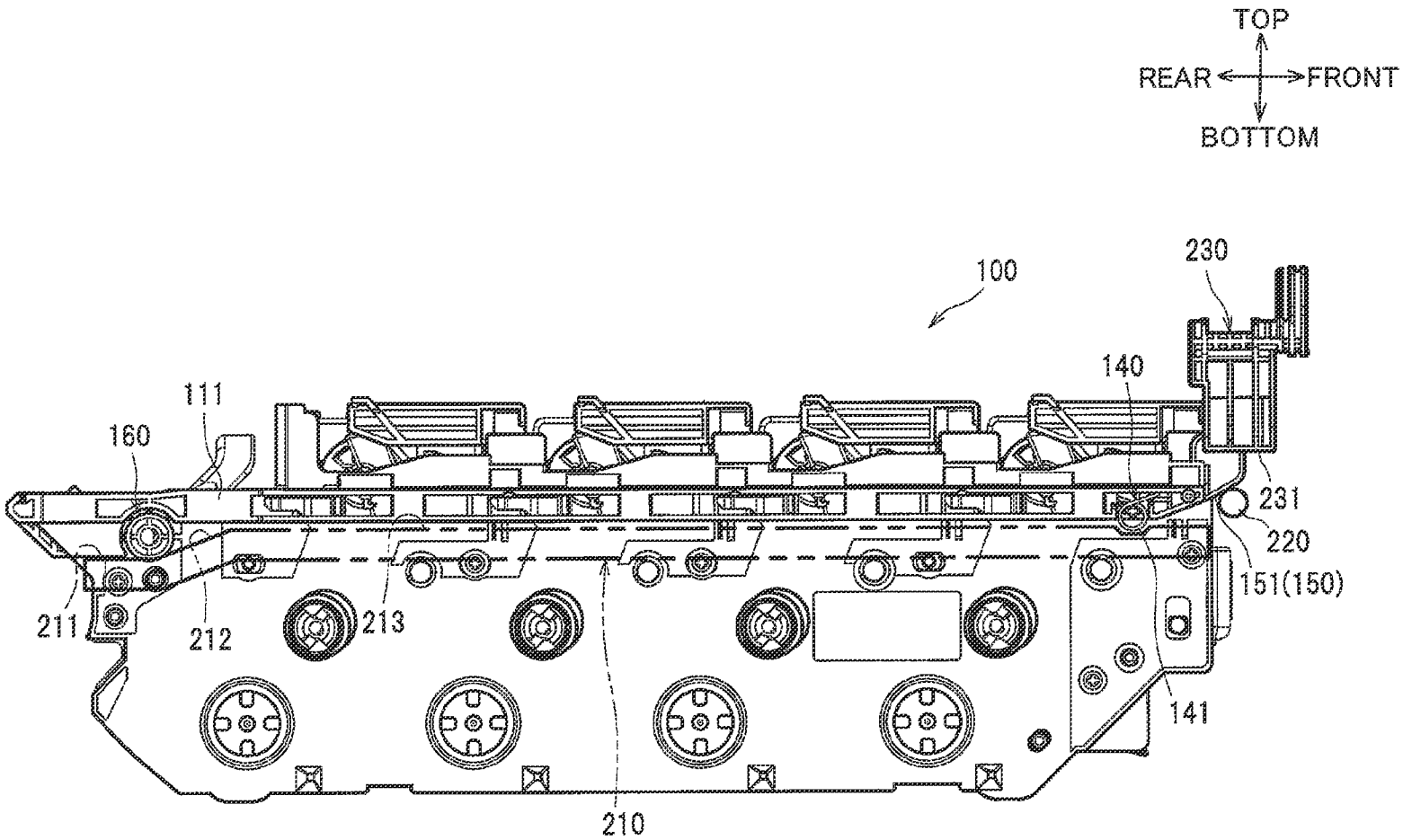
FIG. 5 is a view showing a positional relationship between the holder and a guide rail provided in a main casing of the color printer according to the embodiment.

As shown in FIG. 5, the guide roller 160 is rotatably supported to each side wall 110 at an outer side of the side wall 110 in the left-right direction. The guide roller 160 has a lower end positioned below the lower end of the coil portion 141 of the urging portion 140. Further, the guide roller 160 has an outer end face in the left-right direction positioned substantially in flush with the outer surface of the flange portion 111 in the left-right direction (see FIG. 3).

As shown in FIG. 1, the main casing 10 includes a left and right pair of side frames 200. The left and right pair of side frames 200 is disposed outside the holder 100 in the left-right direction. Further, as shown in FIG. 5, each side frame 200 has an inner surface confronting the holder 100 at which a guide rail 210, the guide roller 220, and a regulation portion 230 are provided.

The guide rail 210 protrudes inward in the left-right direction from the inner surface of the side frame 200. A protruding amount of the guide rail 210 from the inner surface of the side frame 200 in the left-right direction is set so as to sufficiently support the guide roller 160 when the holder 100 is positioned inside the main casing 10.

The guide rail 210 includes a first support portion 211, an inclined portion 212, and a second support portion 213.

The first support portion 211 is disposed at a rear end portion of the main casing 10 and extends substantially horizontally frontward from the rear end portion. Further, the first support portion 211 is disposed at a position in a vertical direction such that a front end portion of the first support portion 211 can support the guide roller 160 when the holder 100 is at the mounted position.

The inclined portion 212 extends diagonally above and frontward continuously from the front end portion of the first support portion 211. The inclined portion 212 is inclined so as to be substantially parallel to the guide surface 151 of the holder 100.

The second support portion 213 extends substantially horizontally and also extends frontward continuously from an upper end portion of the inclined portion 212. More specifically, the second support portion 213 has a front end portion disposed immediately rearward of the guide roller 220. The second support portion 213 is disposed at a position in the vertical direction such that the second support portion 213 can support the guide roller 160 when the flange portion 111 of the holder 100 is interposed between the guide roller 220 and the regulation portion 230. The second support portion 213 is formed with a depressed portion (shown in FIG. 5 without reference numeral) depressed downward from an upper surface of the second support portion 213 at a position confronting the urging portion 140 when the holder 100 is at the mounted position.

Figure 6A:
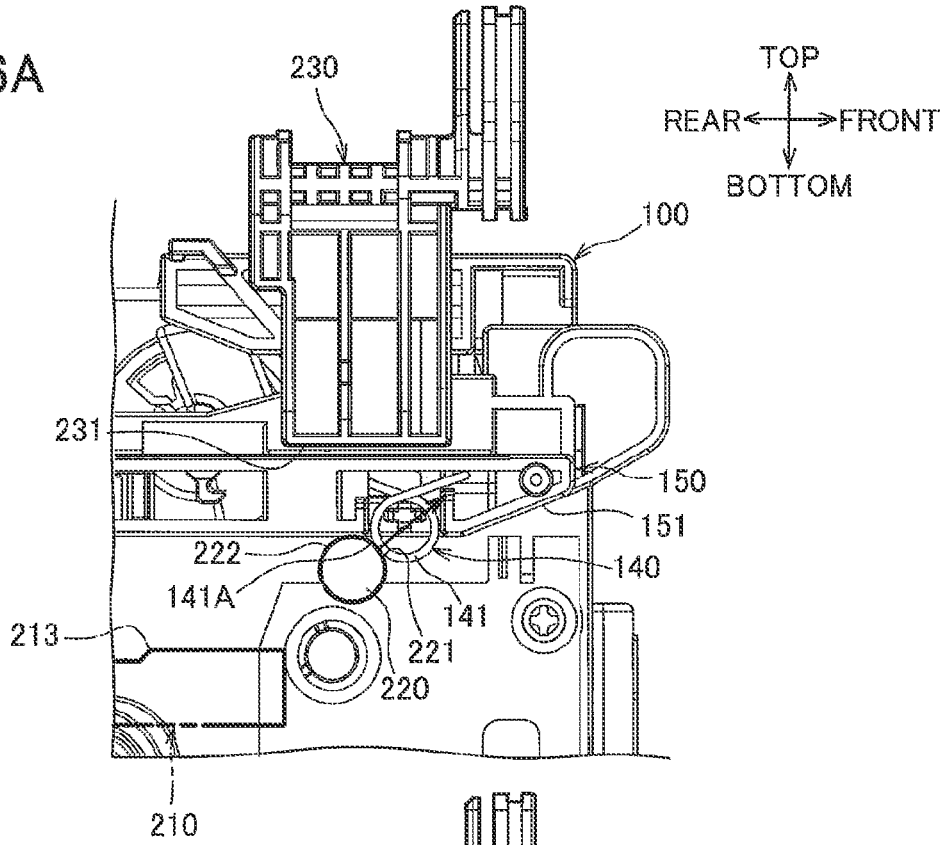
FIG. 6A is an explanatory view showing a state where the urging portion abuts on a guide roller of the main casing when the holder is mounted in the main casing of the color printer according to the embodiment.

As shown in FIG. 6A, the guide roller 220 is rotatably supported to the side frame 200 and disposed at a front end portion of the side frame 200. That is, the guide roller 220 is disposed at an upstream end portion of the side frame 200 (the main casing 10) in the mounting direction. The guide roller 220 has a circular shape, as viewed in the left-right direction, substantially equal in size to the coil portion 141 of the urging portion 140.

Further, the guide roller 220 is disposed at a position in the vertical direction such that an upper end of the guide roller 220 is abuttable on the lower surface of the flange portion 111 when the guide roller 160 is on the second support portion 213. Further, the guide roller 220 is disposed to overlap with the flange portion 111 and the coil portion 141 of the urging portion 140, as viewed in the front-rear direction, when the holder 100 is positioned inside the main casing 10.

Further, as shown in FIG. 6A, the guide roller 220 has an outer peripheral surface, of which a surface facing diagonally above and frontward serves as a second curved surface 221 and a surface facing diagonally above and rearward serves as a fourth curved surface 222 (see FIG. 6A). The second curved surface 221 is abuttable on the coil portion 141 of the urging portion 140 from a downstream side of the urging portion 140 in the mounting direction when the holder 100 moves in the mounting direction. Further, the fourth curved surface 222 is abuttable on the coil portion 141 of the urging portion 140 from a downstream side of the urging portion 140 in the withdrawing direction when the holder 100 moves in the withdrawing direction.

The regulation portion 230 is pivotally movably supported to the side frame 200 at a position above the guide roller 220. The regulation portion 230 has a regulation surface 231 confronting the guide roller 220. The regulation portion 230 is disposed, in the posture shown in FIG. 5, such that the regulation surface 231 is spaced away from an upper end of the guide roller 220 by a distance slightly greater than a vertical thickness of the flange portion 111 so that the flange portion 111 of the holder 100 is interposed between the regulation portion 230 and the guide roller 220.

Next, mounting and withdrawing operations of the holder 100 will be described.

When the holder 100 is mounted in the main casing 10, as shown in FIG. 5, each guide roller 160 of the holder 100 is inserted between the guide roller 220 and the regulation portion 230 to be moved into the main casing 10.

Incidentally, when the guide roller 160 is inserted between the guide roller 220 and the regulation portion 230, the regulation portion 230 is pivotally moved such that the regulation surface 231 moves rightward. Pivotal movement of the regulation portion 230 allows the guide roller 160 to pass through a space between the regulation portion 230 and the guide roller 220. After the guide roller 160 moves past the space, the regulation portion 230 is returned to its original posture shown in FIG. 5.

After passing between the guide roller 220 and the regulation portion 230, the guide roller 160 moves downward from the guide roller 220 to be placed on the second support portion 213. A portion of the flange portion 111 positioned frontward of the guide roller 160 is then interposed between the guide roller 220 and the regulation portion 230.

In this state, the holder 100 moves further rearward into the main casing 10. At this time, the holder 100 moves substantially horizontally along the second support portions 213 of the guide rails 210 and the lower surfaces of the flange portions 111.

Incidentally, at this time, since the flange portion 111 is interposed between the guide roller 220 and the regulation portion 230, the holder 100 is prevented from rattling when moving in the mounting direction.

When the holder 100 is about to reach the mounted position, as shown in FIG. 6A, the urging portion 140 of the holder 100 abuts on the guide roller 220 from the upstream side thereof in the mounting direction. More specifically, the first curved surface 141A of the urging portion 140 is brought into abutment with the second curved surface 221 of the guide roller 220. At this time, the urging portion 140 applies, to the holder 100 to which the urging portion 140 is supported, the mounting resistance force in the direction opposite to the mounting direction. Hence, the momentum of the holder 100 being mounted is weakened.

Figure 6B:
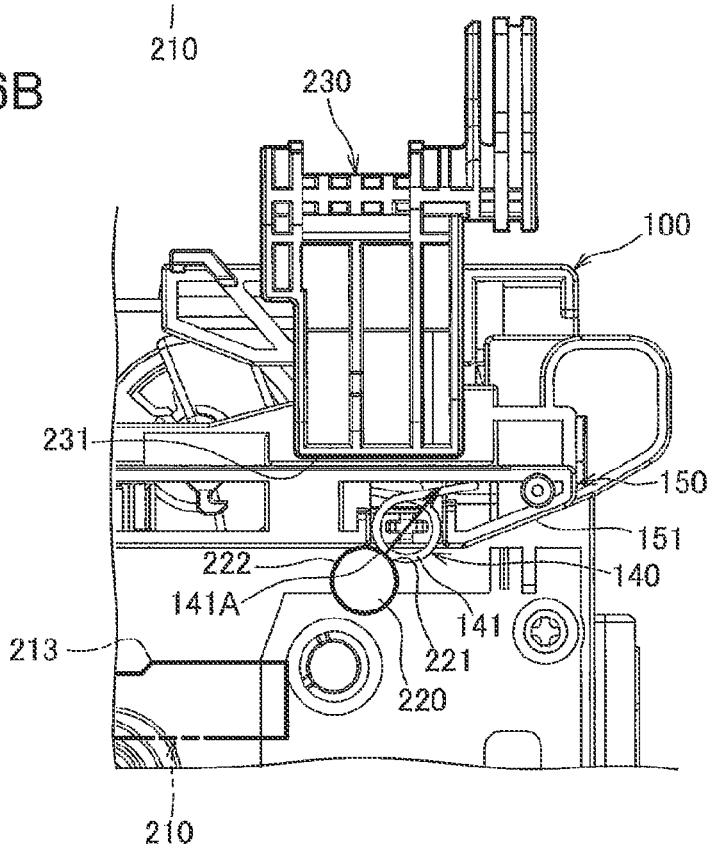
FIG. 6B is an explanatory view showing a state where the urging portion is in abutment with the guide roller of the main casing and a mounting resistance force of the urging portion applied to the holder is the maximum.

When the holder 100 further moves in the mounting direction, as shown in FIG. 6B, the urging portion 140 is pressed upward by the guide roller 220 to start resiliently deforming upward. As a result, the coil portion 141 moves upward along the second curved surface 221 of the guide roller 220 so as to ride up on the top of the guide roller 220.

Figure 7A:
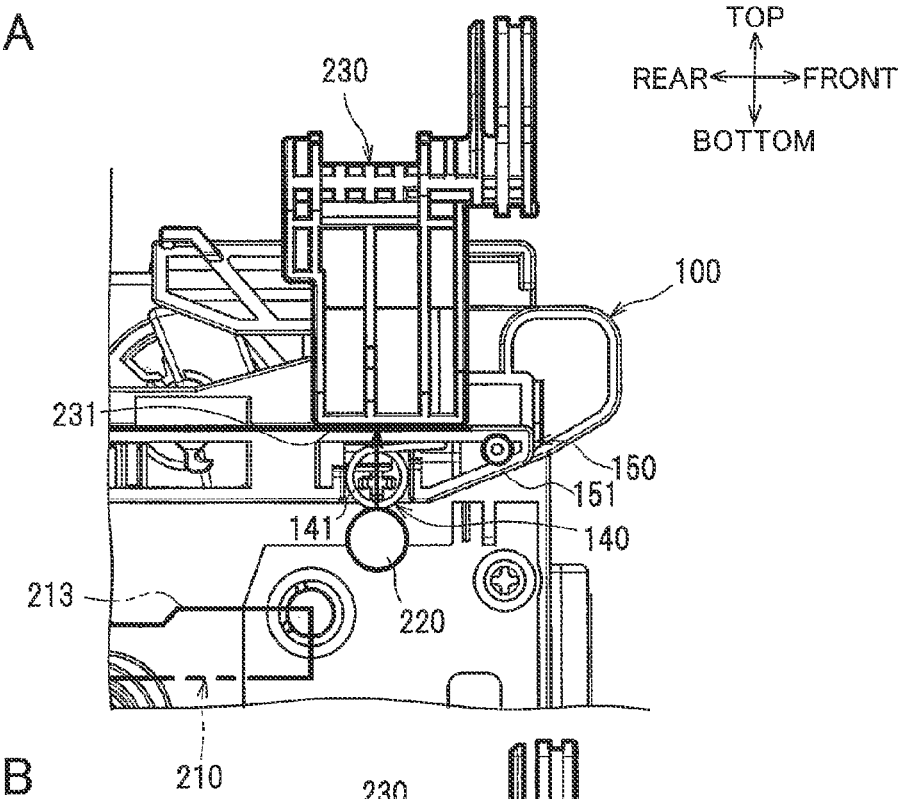
FIG. 7A is an explanatory view showing a state where the urging portion rides up on the top of the guide roller of the main casing when the holder is mounted in the main casing of the color printer according to the embodiment.

Then, as shown in FIG. 7A, when the coil portion 141 of the urging portion 140 moves onto the top of the guide roller 220, the urging portion 140 is pressed vertically upward by the guide roller 220. Accordingly, the urging portion 140 stops applying the mounting resistance force to the holder 100.

Figure 7B:
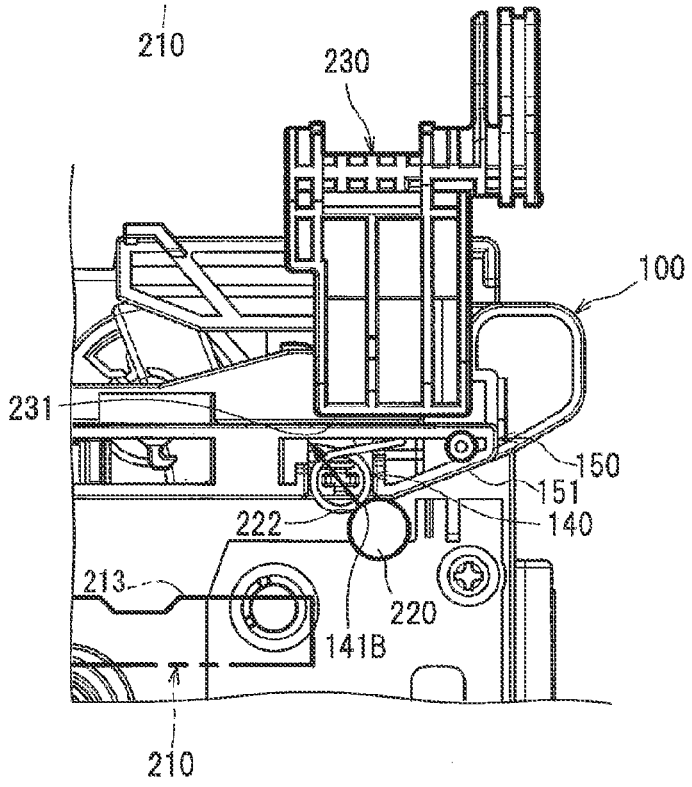
FIG. 7B is an explanatory view showing a state where the urging portion moves past the top of the guide roller of the main casing when the holder is mounted in the main casing of the color printer according to the embodiment.

Thereafter, as the holder 100 still further moves in the mounting direction, as shown in FIG. 7B, the coil portion 141 of the urging portion 140 moves past the top of the guide roller 220. The third curved surface 141B of the coil portion 141 is then brought into abutment with the fourth curved surface 222 of the guide roller 220.

Figure 8A:
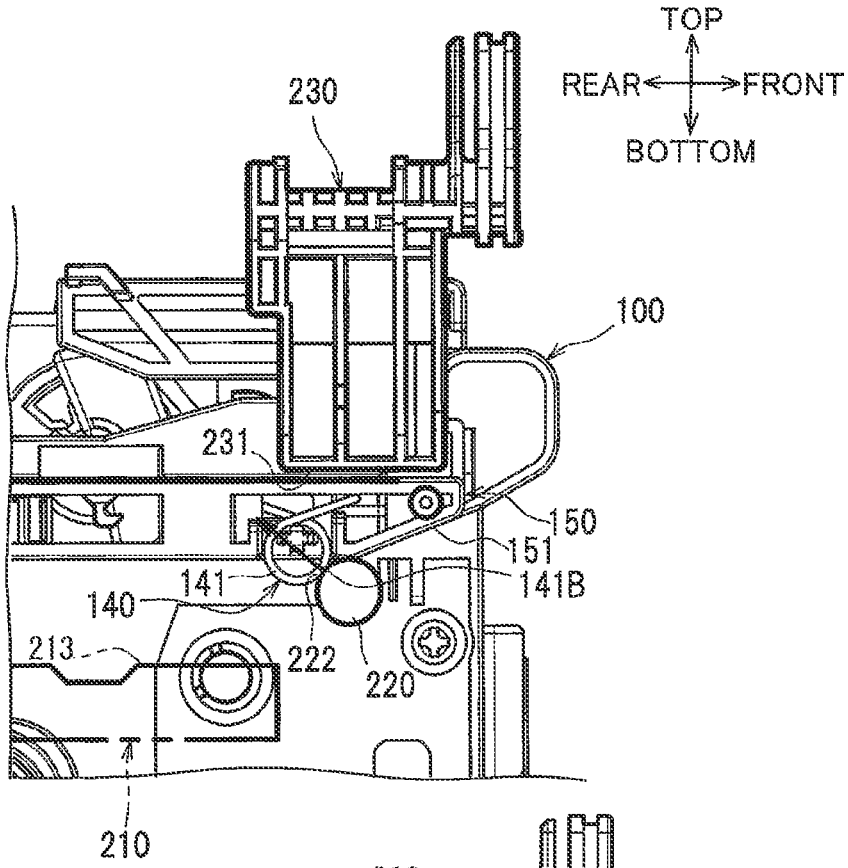
FIG. 8A is an explanatory view showing a state where the urging portion is about to separating from the guide roller of the main casing when the holder is mounted in the main casing of the color printer according to the embodiment.

As the holder 100 further moves in the mounting direction, as shown in FIG. 8A, the coil portion 141 of the urging portion 140 moves downward along the fourth curved surface 222 of the guide roller 220, with a resilient force of the urging portion 140 pressing the guide roller 220 frontward. As a result, a mounting assistance force (i.e. propulsion force) in the mounting direction for assisting the mounting movement of the holder 100 is applied to the holder 100 from the urging portion 140. Hence, the user can mount the holder 100 in the main casing 10 with a small force.

When the coil portion 141 of the urging portion 140 moves past (rearward of) the guide roller 220, the guide surface 151 of the guide portion 150 is placed on the guide roller 220.

Figure 8B:
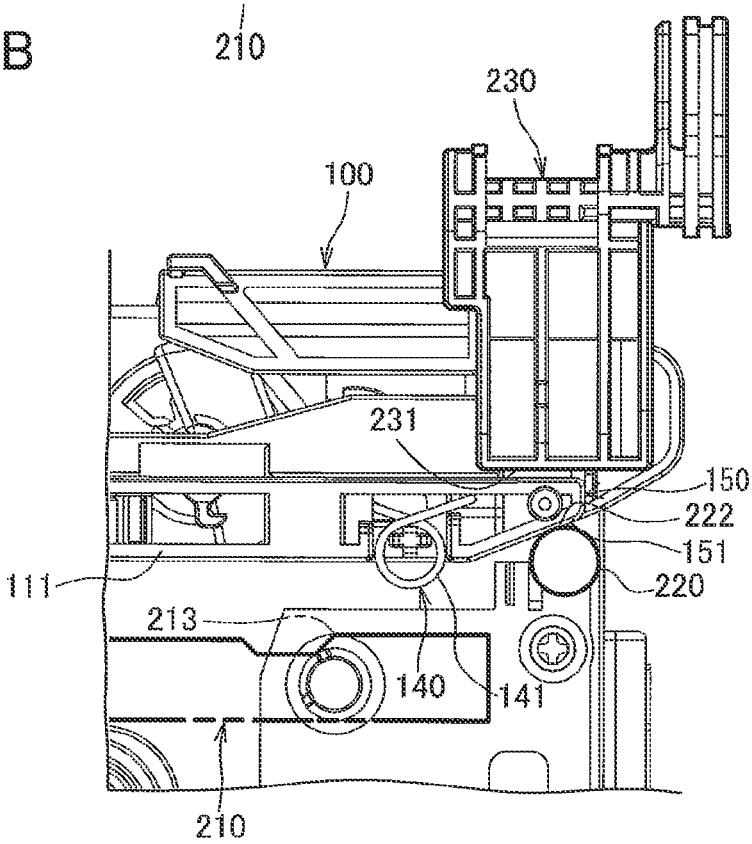
FIG. 8B is an explanatory view showing a state where a front end portion of the holder is supported by the guide roller of the main casing of the color printer according to the embodiment.

In this state, as the holder 100 still further moves in the mounting direction, as shown in FIG. 8B, the guide surface 151 moves rearward, being supported by the guide roller 220. Further, at the rear end portion of the holder 100, as shown in FIG. 5, the guide roller 160 moves rearward, being supported by the inclined portion 212 of the guide rail 210. Hence, the holder 100 gradually moves downward toward the mounted position. As a result, the holder 100 is mounted in the main casing 10, with the front end portion thereof being supported by the guide roller 220, and the rear end portion thereof being supported by the first support portion 211 of the guide rail 210.

Next, the mounting resistance force applied to the holder 100 from the urging portion 140 when the holder 100 is mounted in the main casing 10 will be described while referring to FIG. 9.

Figure 9:
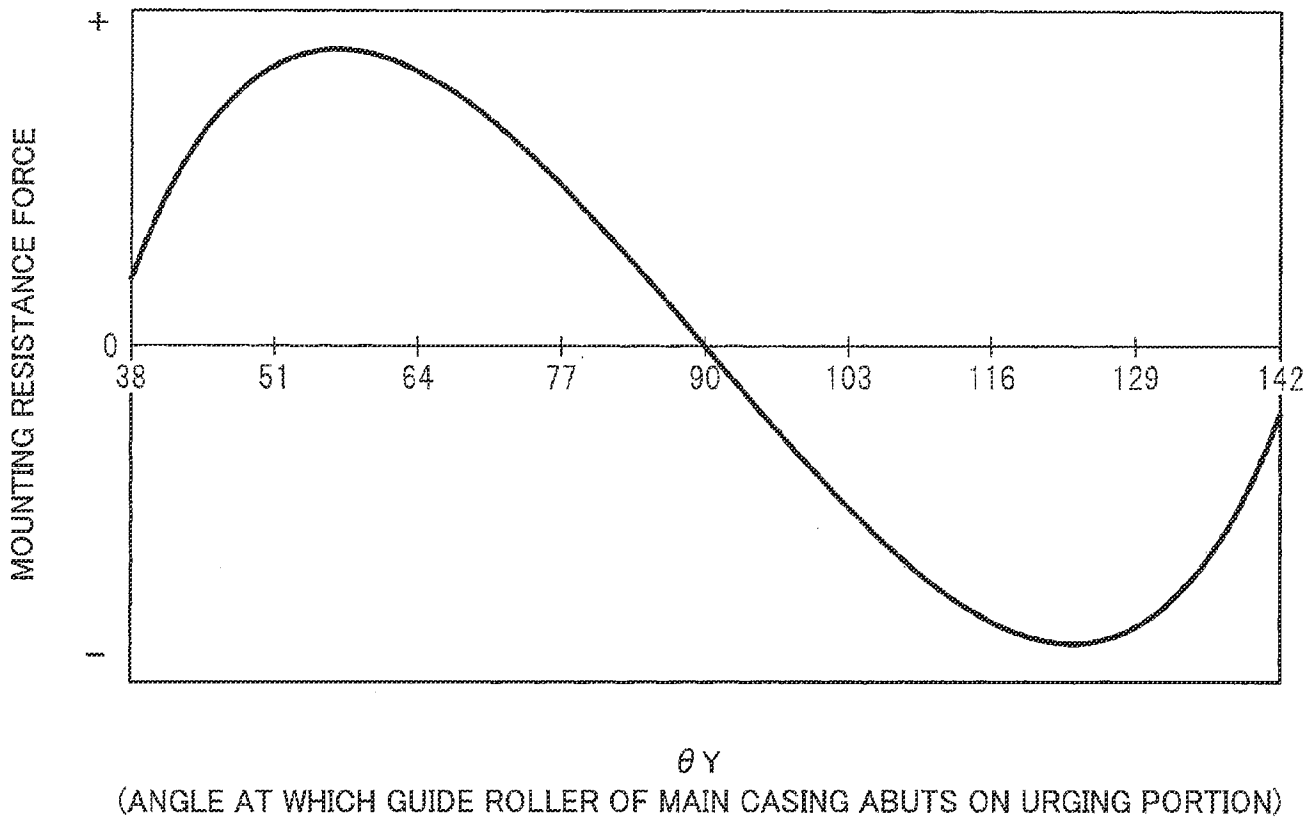
FIG. 9 is a graph showing a relationship between an angle at which the urging portion abuts on the guide roller of the main casing and a resistance force of the urging portion applied to the holder when the holder is mounted in the main casing of the color printer according to the embodiment.

Note that "θy" indicated in the abscissa of the graph shown in FIG. 9 represents an angle of a plane passing the center of guide roller 220 and the center of the coil portion 141 with respect to a horizontal plane. For example, in a state shown in FIG. 6A, θy is 38 degrees, and in a state shown in FIG. 7A, θy is 90 degrees, and in a state shown in FIG. 8A, θy is 142 degrees.

The mounting resistance force is generated at a time when the first curved surface 141A of the urging portion 140 starts abutting on the second curved surface 221 of the guide roller 220 (that is, when θy is 38 degrees). The mounting resistance force continuously increases, and then, continuously decreases to be zero during a period of time from when the first curved surface 141A starts abutting on the second curved surface 221 until the coil portion 141 of the urging portion 140 rides up on the top of the guide roller 220 (that is, until θy becomes 90 degrees), because the urging portion 140 is resiliently deformed while moving with the first curved surface 141A of the urging portion 140 being in abutment with the second curved surface 221 of the guide roller 220.

After the coil portion 141 moves past the top of the guide roller 220, the holder 100 is pressed by the resilient force of the urging portion 140 while the urging portion 140 moves with the third curved surface 141B of the urging portion 140 being in abutment with the fourth curved surface 222 of the guide roller 220. Accordingly, the mounting assistance force in the mounting direction, that is, the mounting resistance force with a negative value, is applied to the holder 100 from the urging portion 140.

The mounting assistance force (the mounting resistance force with a negative value) continuously increases, and then, continuously decreases during a period of time from when the coil portion 141 of the urging portion 140 moves past the top of the guide roller 220 (that is, when θy exceeds 90 degrees) until the coil portion 141 separates from the guide roller 220 (that is, until θy becomes 142 degrees in a state shown in FIG. 8A).

To withdraw the holder 100 from the main casing 10, the steps in the operation for mounting the holder 100 in the main casing 10 described above are performed in reverse.

More specifically, when the holder 100 moves from the mounted position shown in FIG. 5 in the withdrawing direction, each guide surface 151 of the guide portion 150 moves diagonally above and frontward, being supported by the guide roller 220. Further, at the rear end portion of the holder 100, each guide roller 160 moves diagonally above and frontward along the inclined portion 212 of the guide rail 210. Hence, after the holder 100 moves diagonally above and frontward from the mounted position, the guide roller 160 is supported by the second support portion 213 of the guide rail 210 at the rear portion of the holder 100, and the flange portion 111 is supported by the guide roller 220 at the front end portion of the holder 100.

Further, at this time, as shown in FIG. 8A, the urging portion 140 of the holder 100 abuts on the guide roller 220 from the upstream side thereof in the withdrawing direction. More specifically, the third curved surface 141B of the urging portion 140 is brought into abutment with the fourth curved surface 222 of the guide roller 220. At this time, the urging portion 140 applies, to the holder 100 to which the urging portion 140 is supported, the withdrawing resistance force in the direction opposite to the withdrawing direction. Hence, the momentum of the holder 100 being withdrawn is weakened.

When the holder 100 further moves in the withdrawing direction, as shown in FIG. 7B, the urging portion 140 is pressed upward by the guide roller 220 to start resiliently deforming upward. As a result, the coil portion 141 moves upwards along the fourth curved surface 222 of the guide roller 220 so as to ride up on the top of the guide roller 220.

Then, after the coil portion 141 of the urging portion 140 moves past the top of the guide roller 220 as shown in FIG. 7A, the first curved surface 141A of the urging portion 140 is brought into abutment with the second curved surface 221 of the guide roller 220 as shown in FIG. 6B.

As the holder 100 further moves in the withdrawing direction, as shown in FIG. 6A, the coil portion 141 of the urging portion 140 moves downward along the second curved surface 221 of the guide roller 220, with a resilient force of the urging portion 140 pressing the guide roller 220 rearward. As a result, a withdrawing assistance force (i.e. propulsion force) in the withdrawing direction for assisting the withdrawing movement of the holder 100 is applied to the holder 100 from the urging portion 140. Hence, the user can withdraw the holder 100 from the main casing 10 with a small force.

Thereafter, the holder 100 still further moves in the withdrawing direction. The holder 100 moves substantially horizontally along the second support portions 213 of the guide rails 210 and the lower surfaces of the flange portions 111. Hence, the holder 100 moves to the withdrawn position.

Here, the withdrawing resistance force applied to the holder 100 from the urging portion 140 when the holder 100 is withdrawn from the main casing 10 will be described while referring to FIG. 9.

The change in the withdrawing resistance force applied to the holder 100 when the holder 100 moves in the withdrawing direction is substantially the same as the change in the mounting resistance force applied to the holder 100 when the holder 100 moves in the mounting direction. More specifically, the withdrawing resistance force continuously increases, and then, continuously decreases to be zero during a period of time from when the third curved surface 141B of the urging portion 140 starts abutting on the fourth curved surface 222 of the guide roller 220 until the coil portion 141 of the urging portion 140 rides up on the top of the guide roller 220 (see FIG. 9).

During a period of time from when the coil portion 141 moves past the top of the guide roller 220 until the coil portion 141 separates from the guide roller 220, the withdrawing resistance force with a negative value, that is, the withdrawing assistance force in the withdrawing direction, is applied to the holder 100 from the urging portion 140.

The withdrawing assistance force continuously increases, and then, continuously decreases during a period of time from when the coil portion 141 of the urging portion 140 moves past the top of the guide roller 220 until the coil portion 141 separates from the guide roller 220 (see FIG. 9).

According to the above, the following operations and advantageous effects can be obtained in the present embodiment.

During the mounting operation of the holder 100 in the main casing 10, when the holder 100 is about to reach the mounted position, the mounting resistance force in the direction opposite to the mounting direction is applied to the holder 100 from the urging portion 140. Hence, the momentum of the holder 100 being mounted can be weakened. Further, at this time, the mounting resistance force applied to the holder 100 continuously increases, and then, continuously decreases, without rapidly increasing or decreasing, thereby allowing the user to mount the holder 100 in the main casing 10 without making the user feel uncomfortable.

The mounting resistance force gradually changes as the urging portion 140 moves with the first curved surface 141A of the urging portion 140 being in abutment with the second curved surface 221 of the guide roller 220. Hence, the change in the mounting resistance force can be realized by a simple configuration.

Because the urging portion 140 is configured of the torsion coil spring, the mounting resistance force can gradually change. Hence, the change in the mounting resistance force can be realized by a simple configuration.

When the holder 100 is being withdrawn from the main casing 10, a withdrawing resistance force in the direction opposite to the withdrawing direction is applied to the holder 100 from the urging portion 140. Hence, the momentum of the holder 100 being withdrawn can be weakened. Further, at this time, the withdrawing resistance force applied to the holder 100 continuously increases, and then, continuously decreases, without rapidly increasing or decreasing, thereby allowing the user to withdraw the holder 100 without any uncomfortable feeling.

Further, the urging portion 140 is a single member configured to apply, to the holder 100, not only the mounting resistance force but also the withdrawing resistance force. Accordingly, it is not necessary to provide separate members for applying the mounting resistance force and the withdrawing resistance force separately. Hence, the number of parts can be reduced.

The urging portion 140 is brought into abutment with the guide roller 220 immediately before the holder 100 is positioned at the mounted position. For example, if the urging portion 140 and the guide roller 220 are provided at the downstream end portions of the holder 100 and the main casing 10 in the mounting direction, respectively, the urging portion 140 and the guide roller 220 are required to be disposed on the further downstream side of the side wall 110 of the holder 100. However, according to the present embodiment, the urging portion 140 is disposed at the upstream end portion of the holder 100 in the mounting direction, and the guide roller 220 is disposed at the upstream end portion of the main casing 10 in the mounting direction. Hence, the urging portion 140 and the guide roller 220 can be disposed to overlap with the side walls 110 of the holder 100 as viewed in the left-right direction. As a result, the main casing 10 can be made more compact.

Further, various modifications are conceivable.

<First Modification>

Figure 10A:
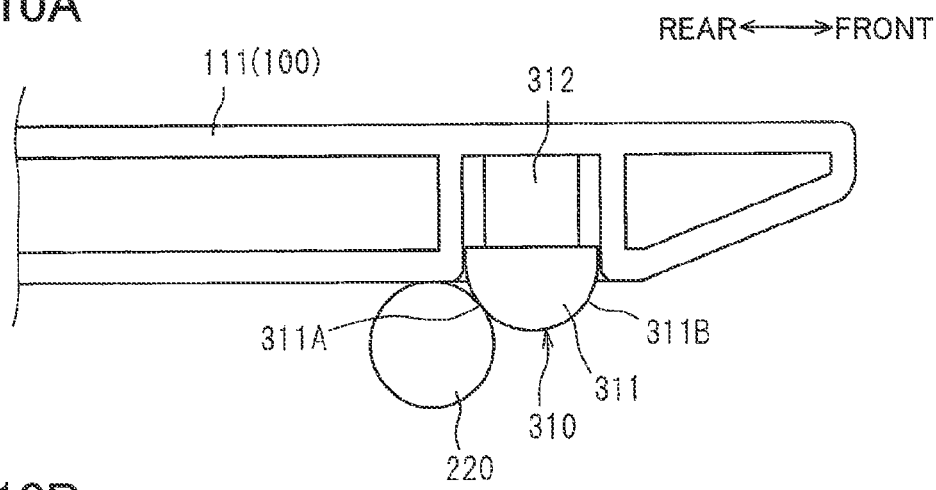
FIG. 10A is a view showing an urging portion according to a first modification of the present invention.

An urging portion 310 according to a first modification of the present invention will be described while referring to FIG. 10A. In the following description, only parts differing from those of the embodiment will be described.

In the above-described embodiment, the urging portion 140 is a torsion coil spring. However, as shown in FIG. 10A, the urging portion 310 includes a pressing portion 311 and a compression spring 312 (resilient member). The pressing portion 311 is made of a material not resiliently deformed, such as resin.

The pressing portion 311 is formed in a semi-circular shape as viewed in the left-right direction. The pressing portion 311 has a portion exposed to an outside from the lower surface of the flange portion 111 of the holder 100.

Further, the exposed portion of the pressing portion 311 has a surface facing the downstream side thereof in the mounting direction, and this surface serves as a first curved surface 311A abuttable on the guide roller 220 from the upstream side thereof in the mounting direction when the holder 100 is mounted in the main casing 10. The exposed portion of the pressing portion 311 also has a surface facing the upstream side thereof in the mounting direction, and this surface serves as a third curved surface 311B abuttable on the guide roller 220 from the upstream side thereof in the withdrawing direction when the holder 100 is withdrawn from the main casing 10.

The compression spring 312 has one end fixed to the flange portion 111 and another end fixed to the pressing portion 311, so that the compression spring 312 can be compressed and stretched in the vertical direction.

When the holder 100 is mounted in the main casing 10, the first curved surface 311A of the urging portion 310 is brought into abutment with the guide roller 220, so that the pressing portion 311 is pressed upward by the guide roller 220. At this time, the urging portion 310 applies, to the holder 100, a mounting resistance force in a direction opposite to the mounting direction. Similar to the above-described embodiment, this mounting resistance force continuously increases, and then, continuously decreases, thereby allowing the user to mount the holder 100 in the main casing 10 without any uncomfortable feeling.

Further, when the holder 100 is withdrawn from the main casing 10, the third curved surface 311B of the urging portion 310 is brought into abutment with the guide roller 220, so that the pressing unit 311 is pressed upward by the guide roller 220. At this time, the urging portion 310 applies, to the holder 100, a withdrawing resistance force in a direction opposite to the withdrawing direction. Similar to the above-described embodiment, this withdrawing resistance force continuously increases, and then, continuously decreases, thereby allowing the user to withdraw the holder 100 from the main casing 10 without any uncomfortable feeling.

<Second Modification>

Figure 10B:
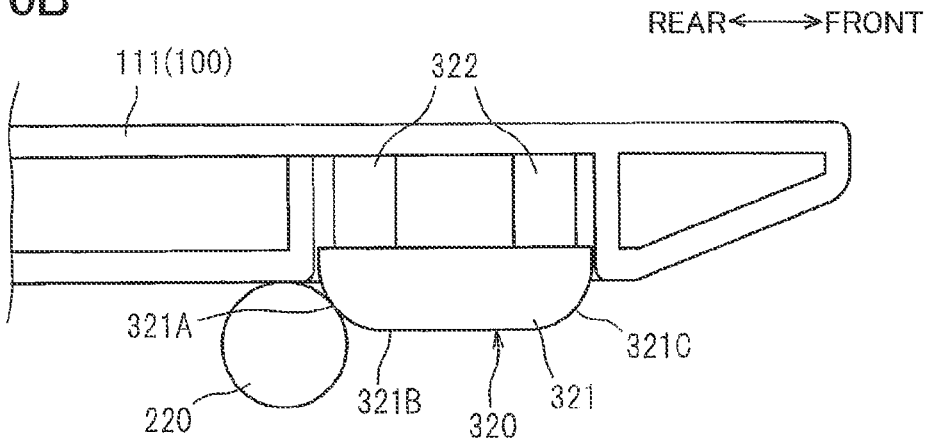
FIG. 10B is a view showing an urging portion according to a second modification of the present invention.

An urging portion 320 according to a second modification of the present invention will be described while referring to FIG. 10B. In the following description, only parts differing from those of the embodiment will be described.

In the first modification, the pressing portion 311 is formed in a semi-circular shape as viewed in the left-right direction. However, as shown in FIG. 10B, a pressing portion 321 of the urging portion 320 is formed in an elongated shape extending in the front-rear direction as viewed in the left-right direction.

The pressing portion 321 has a first curved surface 321A, a horizontal surface 321B, and a third curved surface 321C. The first curved surface 321A is abuttable on the guide roller 220 from the upstream side thereof in the mounting direction when the holder 100 is mounted in the main casing 10. The horizontal surface 321B connects a front end portion of the first curved surface 321A (an end portion closer to the third curved surface 321C) and a rear end portion of the third curved surface 321C (an end portion closer to the first curved surface 321A). The third curved surface 321C is abuttable on the guide roller 220 from the upstream side thereof in the withdrawing direction when the holder 100 is withdrawn from the main casing 10.

The urging portion 320 further includes two compression springs 322 provided at front and rear end portions of the pressing portion 321, respectively. The pressing portion 321 is supported to the flange portion 111 via the compression springs 322, and vertically movable relative to the flange portion 111.

With this configuration, when the pressing portion 321 moves on the guide roller 220 with the horizontal surface 321B being in abutment with the guide roller 220, the urging portion 320 applies, to the holder 100, a mounting resistance force or a withdrawing resistance force due to a frictional force generated between the pressing portion 321 and the guide roller 220. Accordingly, this configuration allows the urging portion 320 to apply the mounting resistance force or the withdrawing resistance force to the holder 100 for a prolonged period of time. Hence, the momentum of the holder 100 when the holder 100 is mounted in the main casing 10 and also when the holder 100 is withdrawn from the main casing 10 can be sufficiently weakened.

<Third Modification>

Figure 10C:
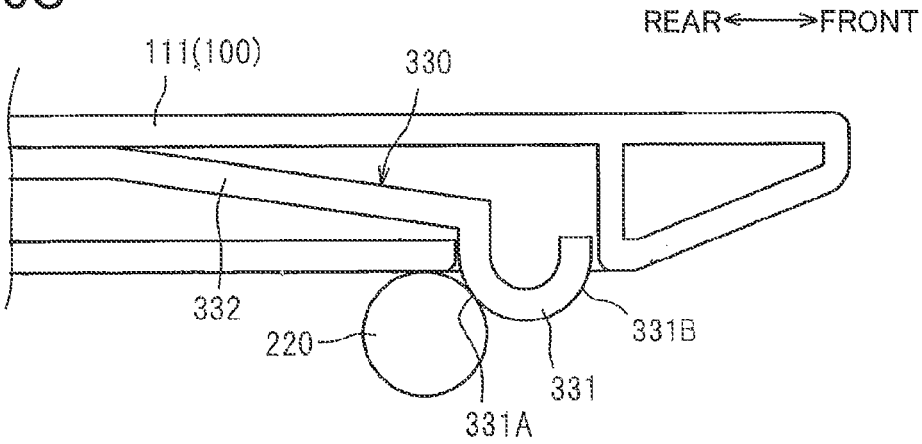
FIG. 10C is a view showing an urging portion according to a third modification of the present invention.

A leaf spring 330 according to a third modification of the present invention will be described while referring to FIG. 10C. In the following description, only parts differing from those of the embodiment will be described.

In place of the urging portion 140 in the above-described embodiment, the leaf spring 330 is provided in the holder 100. The leaf spring 330 includes a pressing portion 331 and an arm portion 332. The pressing portion 331 is formed in a generally U-shape as viewed in the left-right direction and has a portion exposed to an outside from the lower surface of the flange portion 111 of the holder 100.

The exposed portion of the pressing portion 331 has a surface facing the downstream side thereof in the mounting direction, and this surface serves as a first curved surface 331A abuttable on the guide roller 220 from the upstream side thereof in the mounting direction when the holder 100 is mounted in the main casing 10. The exposed portion of the pressing portion 331 also has a surface facing the upstream side thereof in the mounting direction, and this surface serves as a third curved surface 331B abuttable on the guide roller 220 from the upstream side thereof in the withdrawing direction when the holder 100 is withdrawn from the main casing 10.

The arm portion 332 extends diagonally above and rearward from a rear end portion of the pressing portion 331. The arm portion 332 has a front end portion continuous from the pressing portion 331, and a rear end portion supported to the flange portion 111 of the holder 100. With this configuration, the pressing portion 331 is vertically movable relative to the flange portion 111.

When the holder 100 is mounted in the main casing 10, the first curved surface 331A of the leaf spring 330 is brought into abutment with the guide roller 220, so that the pressing portion 331 is pressed upward by the guide roller 220. At this time, the leaf spring 330 applies, to the holder 100, a mounting resistance force in a direction opposite to the mounting direction. Similar to the above-described embodiment, this mounting resistance force continuously increases, and then, continuously decreases, thereby allowing the user to mount the holder 100 in the main casing 10 without any uncomfortable feeling.

Further, when the holder 100 is withdrawn from the main casing 10, the third curved surface 331B of the leaf spring 330 is brought into abutment with the guide roller 220, so that the pressing portion 331 is pressed upward by the guide roller 220. At this time, the leaf spring 330 applies, to the holder 100, a withdrawing resistance force in a direction opposite to the withdrawing direction. Similar to the above-described embodiment, this withdrawing resistance force continuously increases, and then, continuously decreases, thereby allowing the user to withdraw the holder 100 from the main casing 10 without any uncomfortable feeling.

<Fourth Modification>

Figure 11:
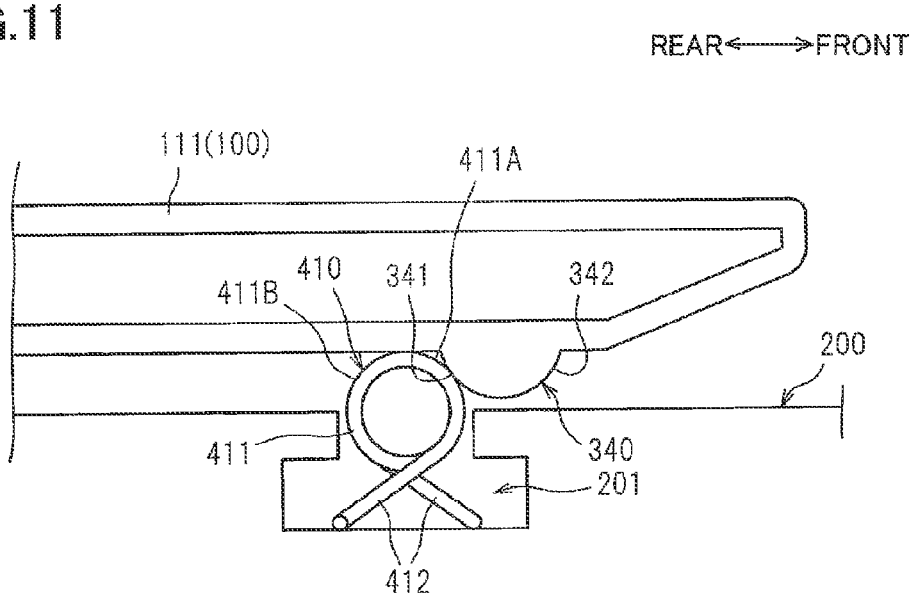
FIG. 11 is a view showing an abutment portion and an urging portion according to a fourth modification of the present invention.

An abutment portion 340 and an urging portion 410 according to a fourth modification of the present invention will be described while referring to FIG. 11. In the following description, only parts differing from those of the embodiment will be described.

In the above-described embodiment, the urging portion 140 is provided at the holder 100 and the guide roller 220 is provided at the main casing 10. However, as shown in FIG. 11, the abutment portion 340 is provided at the holder 100 and the urging portion 410 is provided at the main casing 10 (the side frame 200).

The abutment portion 340 has a semi-circular shape as viewed in the left-right direction and protrudes downward from the lower surface of the flange portion 111. The abutment portion 340 has a second curved surface 341 and a fourth curved surface 342. The second curved surface 341 is abuttable on the urging portion 410 from an upstream side thereof in the mounting direction when the holder 100 is mounted in the main casing 10. Further, the fourth curved surface 342 is abuttable on the urging portion 410 from an upstream side thereof in the withdrawing direction when the holder 100 is withdrawn from the main casing 10.

The urging portion 410 is formed of a torsion coil spring (resilient member) including a coil portion 411 and an arm portion 412. The urging portion 410 is supported in a depressed portion 201 formed in the side frame 200. The depressed portion 201 is depressed downward from an upper surface of the side frame 200. The coil portion 411 has an upper half portion exposed to an outside from the depressed portion 201. Further, the upper half portion of the coil portion 411 exposed to the outside from the depressed portion 201 has an outer peripheral surface, of which a surface facing the upstream side thereof in the mounting direction serves as a first curved surface 411A and a surface facing the downstream side thereof in the mounting direction serves as a third curved surface 411B. The first curved surface 411A is abuttable on the abutment portion 340 from the downstream side thereof in the mounting direction when the holder 100 is mounted in the main casing 10. Further, the third curved surface 411B is abuttable on the abutment portion 340 from the downstream side thereof in the withdrawing direction when the holder 100 is withdrawn from the main casing 10.

The arm portion 412 includes two arm segments extending downward from the coil portion 411 to contact a lower surface of the depressed portion 201.

With this configuration, when the holder 100 is mounted in the main casing 10, the second curved surface 341 of the abutment portion 340 is brought into abutment with the first curved surface 411A of the urging portion 410 to press the coil portion 411 of the urging portion 410 downward. At this time, the urging portion 410 presses against the abutment portion 340. As a result, the urging portion 410 applies, to the holder 100, a mounting resistance force in a direction opposite to the mounting direction via the abutment portion 340. Similar to the above-described embodiment, this mounting resistance force continuously increases, and then, continuously decreases, thereby allowing the user to mount the holder 100 in the main casing 10 without any uncomfortable feeling.

Further, when the holder 100 is withdrawn from the main casing 10, the fourth curved surface 342 of the abutment portion 340 is brought into abutment with the third curved surface 411B of the urging portion 410 to press the coil portion 411 downward. At this time, the urging portion 410 presses against the abutment portion 340. As a result, the urging portion 410 applies, to the holder 100, a withdrawing resistance force in a direction opposite to the withdrawing direction via the abutment portion 340. Similar to the above-described embodiment, this withdrawing resistance force continuously increases, and then, continuously decreases, thereby allowing the user to withdraw the holder 100 from the main casing 10 without any uncomfortable feeling.

<Fifth Modification>

Figure 12A:
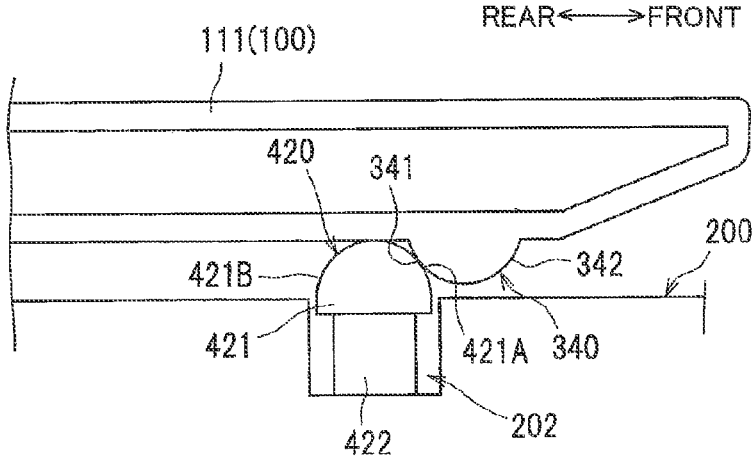
FIG. 12A is a view showing an urging portion according to a fifth modification of the present invention.

An urging portion 420 according to a fifth modification of the present invention will be described while referring to FIG. 12A. In the following description, only parts differing from those of the embodiment and fourth modification will be described.

In the fourth modification, the urging portion 410 is formed of a torsion coil spring. However, as shown in FIG. 12A, the urging portion 420 includes a pressing portion 421 and a compression spring 422 (resilient member). The pressing portion 421 is made of a material not resiliently deformed, such as resin.

The pressing portion 421 is formed in a semi-circular shape as viewed in the left-right direction. The pressing portion 421 has a portion exposed to an outside from a depressed portion 202 formed in the side frame 200.

Further, the exposed portion of the pressing portion 421 has a surface facing the upstream side thereof in the mounting direction, and this surface serves as a first curved surface 421A abuttable on the abutment portion 340 of the holder 100 from the downstream side thereof in the mounting direction when the holder 100 is mounted in the main casing 10. The exposed portion of the pressing portion 421 also has a surface facing the downstream side thereof in the mounting direction, and this surface serves as a third curved surface 421B abuttable on the abutment portion 340 of the holder 100 from the downstream side thereof in the withdrawing direction when the holder 100 is withdrawn from the main casing 10.

The compression spring 422 has one end fixed to a lower surface of the depressed portion 202 and another end fixed to the pressing portion 421, so that the compression spring 422 can be compressed and stretched in the vertical direction.

With this configuration, when the holder 100 is mounted in the main casing 10, the second curved surface 341 of the abutment portion 340 is brought into abutment with the first curved surface 421A of the urging portion 420 to press the pressing portion 421 of the urging portion 420 downward. At this time, an urging force of the compression spring 422 allows the pressing portion 421 to press against the abutment portion 340. As a result, the urging portion 420 applies, to the holder 100, a mounting resistance force in a direction opposite to the mounting direction via the abutment portion 340. Similar to the above-described embodiment, this mounting resistance force continuously increases, and then, continuously decreases, thereby allowing the user to mount the holder 100 in the main casing 10 without any uncomfortable feeling.

Further, when the holder 100 is withdrawn from the main casing 10, the fourth curved surface 342 of the abutment portion 340 is brought into abutment with the third curved surface 421B of the urging portion 420 to press the pressing portion 421 downward. At this time, the urging force of the compression spring 422 allows the pressing portion 421 to press against the abutment portion 340. As a result, the urging portion 420 applies, to the holder 100, a withdrawing resistance force in a direction opposite to the withdrawing direction via the abutment portion 340. Similar to the above-described embodiment, this withdrawing resistance force continuously increases, and then, continuously decreases, thereby allowing the user to withdraw the holder 100 from the main casing 10 without any uncomfortable feeling.

<Sixth Modification>

Figure 12B:
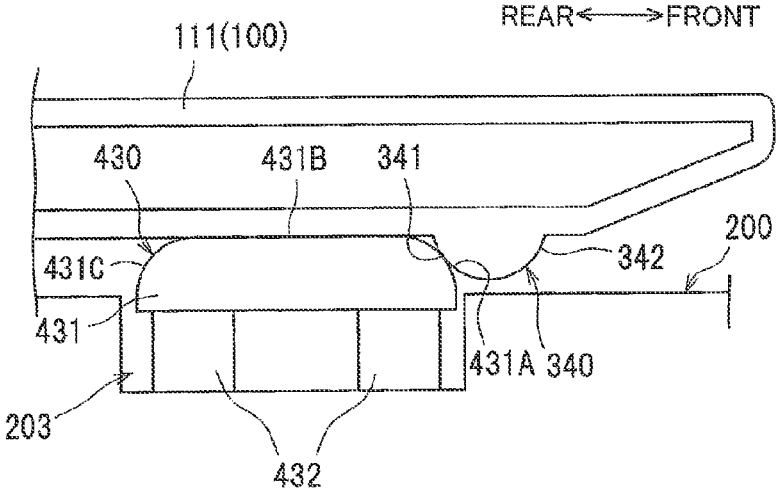
FIG. 12B is a view showing an urging portion according to a sixth modification of the present invention.

An urging portion 430 according to a sixth modification of the present invention will be described while referring to FIG. 12B. In the following description, only parts differing from those of the embodiment and fourth modification will be described.

In the fifth modification, the pressing portion 421 is formed of in a semi-circular shape as viewed in the left-right direction. However, as shown in FIG. 12B, a pressing portion 431 of the urging portion 430 is formed in an elongated shape extending in the front-rear direction as viewed in the left-right direction.

The pressing portion 431 has a first curved surface 431A, a horizontal surface 431B, and a third curved surface 431C. The first curved surface 431A is abuttable on the abutment portion 340 from the downstream side thereof in the mounting direction when the holder 100 is mounted in the main casing 10. The horizontal surface 431B connects a rear end portion of the first curved surface 431A (an end portion closer to the third curved surface 431C) and a front end portion of the third curved surface 431C (an end portion closer to first curved surface 431A). The third curved surface 431C is abuttable on the abutment portion 340 from the downstream side thereof in the withdrawing direction when the holder 100 is withdrawn from the main casing 10.

The urging portion 430 further includes two compression springs 432 provided at front and rear end portions of the pressing portion 431, respectively. The pressing portion 431 is supported to the side frame 200 via the compression springs 432, and vertically movable relative to a depressed portion 203 formed in the side frame 200.

With this configuration, when the abutment portion 340 rides up on the pressing portion 431 to move over the pressing portion 431, being in abutment with the horizontal surface 431B, the urging portion 430 applies, to the holder 100, a mounting resistance force or a withdrawing resistance force via the abutment portion 340 due to a frictional force generated between the abutment portion 340 and the pressing portion 431. Accordingly, this configuration allows the urging portion 430 to apply the mounting resistance force or the withdrawing resistance force to the holder 100 for a prolonged period of time. Hence, the momentum of the holder 100 when the holder 100 is mounted in the main casing 10 and also when the holder 100 is withdrawn from the main casing 10 can be sufficiently weakened.

<Seventh Modification>

Figure 12C:
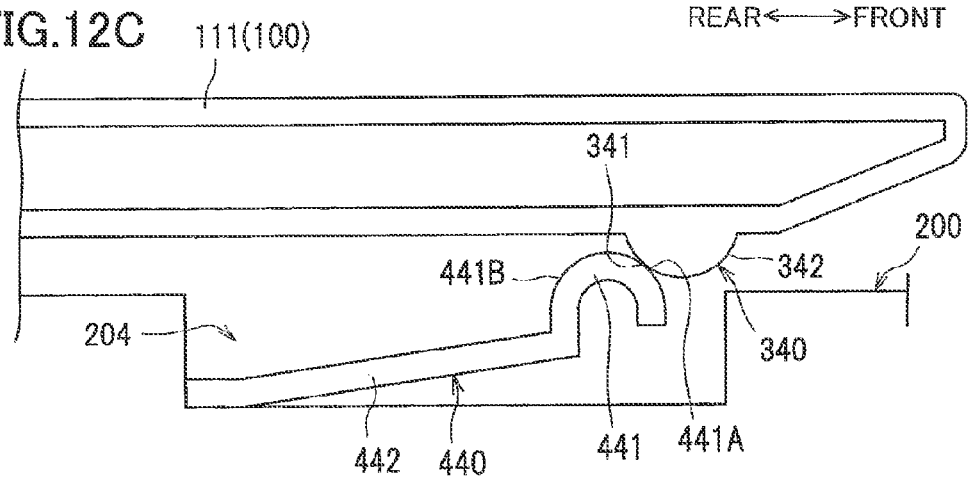
FIG. 12C is a view showing an urging portion according to a seventh modification of the present invention.

A leaf spring 440 according to a seventh modification of the present invention will be described while referring to FIG. 12C. In the following description, only parts differing from those of the embodiment and the fourth modification will be described.

In place of the urging portion 410, the urging portion 420, and the urging portion 430 in the above-described modifications, the leaf spring 440 is provided in the main casing 10. The leaf spring 440 includes a pressing portion 441 and an arm portion 442. The pressing portion 441 is formed in a generally U-shape as viewed in the left-right direction and has a portion exposed to an outside from a depressed portion 204 formed in the side frame 200.

The exposed portion of the pressing portion 441 has a surface facing the upstream side thereof in the mounting direction, and this surface serves as a first curved surface 441A abuttable on the abutment portion 340 from the downstream side thereof in the mounting direction when the holder 100 is mounted in the main casing 10. The exposed portion of the pressing portion 331 also has a surface facing the downstream side thereof in the mounting direction, and this surface serves as a third curved surface 441B abuttable on the abutment portion 340 from the downstream side thereof in the withdrawing direction when the holder 100 is withdrawn from the main casing 10.

The arm portion 442 extends diagonally below and rearward from a rear end portion of the pressing portion 441. The arm portion 442 has a rear end portion fixed to a lower surface of the depressed portion 204, and a front end portion continuous from the pressing portion 441. With this configuration, the pressing portion 441 is vertically movable relative to the lower surface of the depressed portion 204.

When the holder 100 is mounted in the main casing 10, the second curved surface 341 of the abutment portion 340 is brought into abutment with the first curved surface 441A of the leaf spring 440, so that the pressing portion 441 is pressed downward. At this time, the leaf spring 440 presses against the abutment portion 340 to apply, to the holder 100, a mounting resistance force in a direction opposite to the mounting direction via the abutment portion 340. Similar to the above-described embodiment, this mounting resistance force continuously increases, and then, continuously decreases, thereby allowing the user to mount the holder 100 in the main casing 10 without any uncomfortable feeling.

Further, when the holder 100 is withdrawn from the main casing 10, the fourth curved surface 342 of the abutment portion 340 is brought into abutment with the third curved surface 441B of the leaf spring 440, so that the pressing portion 441 is pressed downward. At this time, the leaf spring 440 presses against the abutment portion 340 to apply, to the holder 100, a withdrawing resistance force in a direction opposite to the withdrawing direction via the abutment portion 340. Similar to the above-described embodiment, this withdrawing resistance force continuously increases, and then, continuously decreases, thereby allowing the user to withdraw the holder 100 from the main casing 10 without any uncomfortable feeling.

In the above-described embodiment, the process cartridge 50 is exemplified as a claimed cartridge. However, the present invention is not limited to this. For example, the cartridge may be a developing cartridge or a drum cartridge.

While the present invention has been described in detail with reference to the embodiment thereof, it would be apparent to those skilled in the art that various changes and modifications may be made therein without departing from the spirit of the present invention.

What is claimed is:

1. An image forming apparatus comprising:

a main casing;

a plurality of cartridges;

a cartridge support unit configured to support the plurality of cartridges, the cartridge support unit being configured to move in a withdrawing direction from a mounted position at which the cartridge support unit is mounted inside the main casing to a withdrawn position positioned outward of the mounted position in the withdrawing direction with respect to the main casing, and to move in a mounting direction from the withdrawn position to the mounted position;

an abutment portion disposed at one of the main casing and the cartridge support unit wherein the abutment portion is a roller having a second curved surface; and a first applying portion disposed at the other of the main casing and the cartridge support unit, the first applying portion having a first curved surface configured to abut on the second curved surface of the abutment portion to apply a first resistance force in a direction opposite to the mounting direction to the cartridge support unit when the cartridge support unit moves in the mounting direction, the first curved surface of the first applying portion and the second curved surface of the abutment portion being configured to constantly provide a point-contact therebetween during the abutment of the first curved surface on the second curved surface such that the first resistance force continuously increases and then continuously decreases when the cartridge support unit moves in the mounting direction.

2. The image forming apparatus as claimed in claim 1, wherein the first applying portion comprises a resilient member.

3. The image forming apparatus as claimed in claim 2, wherein the first applying portion is a resilient member.

4. The image forming apparatus as claimed in claim 3, wherein the resilient member is a torsion coil spring.

5. The image forming apparatus as claimed in claim 1, wherein the first applying portion is disposed at the cartridge support unit and the abutment portion is disposed at the main casing, the first applying portion being configured to be resiliently deformed by abutting on the abutment portion.

6. The image forming apparatus as claimed in claim 1, wherein the first applying portion is configured to be resiliently deformed when the first applying portion abuts on the abutment portion to move past the abutment portion.

7. The image forming apparatus as claimed in claim 6, wherein the first applying portion is configured to be resiliently deformed and to retract upward by abutting on the abutment portion.

8. The image forming apparatus as claimed in claim 1, wherein the cartridge support unit has an upstream end portion in the mounting direction, the first applying portion being disposed at the upstream end portion of the cartridge support unit, and wherein the main casing has an upstream end portion in the mounting direction, the abutment portion being disposed at the upstream end portion of the main casing.

9. The image forming apparatus as claimed in claim 1, further comprising a second applying portion disposed at the other of the main casing and the cartridge support unit, the second applying portion being configured to abut on the abutment portion to apply a second resistance force in a direction opposite to the withdrawing direction to the cartridge support unit when the cartridge support unit moves in the withdrawing direction, the second applying portion and the abutment portion being configured such that the second resistance force continuously increases and then continuously decreases when the cartridge support unit moves in the withdrawing direction.

10. The image forming apparatus as claimed in claim 9, wherein the second applying portion is integral with the first applying portion.

11. An image forming apparatus comprising:

a main casing;

a plurality of cartridges;

a cartridge support unit configured to support the plurality of cartridges, the cartridge support unit being configured to move in a withdrawing direction from a mounted position at which the cartridge support unit is mounted inside the main casing to a withdrawn position positioned outward of the mounted position in the withdrawing direction with respect to the main casing, and to move in a mounting direction from the withdrawn position to the mounted position;

an abutment member disposed at one of the main casing and the cartridge support unit, wherein the abutment member is a roller having a second curved surface; and an applying member disposed at the other of the main casing and the cartridge support unit, the applying member having a first applying portion and a second applying portion, the first applying portion having a first curved surface configured to abut on the second curved surface of the abutment member to apply a first resistance force in a direction opposite to the mounting direction to the cartridge support unit when the cartridge support unit moves in the mounting direction, the first curved surface of the first applying portion and the second curved surface of the abutment member being configured to constantly provide a point-contact therebetween during the abutment of the first curved surface on the second curved surface such that the first resistance force continuously increases and then continuously decreases when the cartridge support unit moves in the mounting direction, the second applying portion being configured to abut on the abutment member to apply a second resistance force in a direction opposite to the withdrawing direction to the cartridge support unit when the cartridge support unit moves in the withdrawing direction, the second applying portion and the abutment member being configured such that the second resistance force continuously increases and then continuously decreases when the cartridge support unit moves in the withdrawing direction.

12. The image forming apparatus as claimed in claim 11, wherein the second applying portion is further configured to abut on the abutment member to apply a propulsion force in the mounting direction to the cartridge support unit when the cartridge support unit moves in the mounting direction after the first applying portion has abutted on the abutment member, the second applying portion and the abutment member being further configured such that the propulsion force continuously increases and then continuously decreases when the cartridge support unit moves in the mounting direction after the first applying portion has abutted on the abutment member.

13. The image forming apparatus as claimed in claim 12, wherein the continuously increasing propulsion force is continuous with the continuously decreasing first resistance force.

14. An image forming apparatus comprising:

a main casing;

a plurality of cartridges;

a cartridge support unit configured to support the plurality of cartridges, the cartridge support unit being configured to move in a withdrawing direction from a mounted position at which the cartridge support unit is mounted inside the main casing to a withdrawn position positioned outward of the mounted position in the withdrawing direction with respect to the main casing, and to move in a mounting direction from the withdrawn position to the mounted position;

an abutment portion disposed at one of the main casing and the cartridge support unit wherein at least a portion of a cross-section of the abutment portion has a semi-circular shape having a second curved surface; and a first applying portion disposed at the other of the main casing and the cartridge support unit, wherein at least a portion of a cross-section of the first applying portion has a semi-circular shape having a first curved surface configured to abut on the second curved surface of the abutment portion to apply a first resistance force in a direction opposite to the mounting direction to the cartridge support unit when the cartridge support unit moves in the mounting direction, the first curved surface of the first applying portion and the second curved surface of the abutment portion being configured to constantly provide a point-contact therebetween during the abutment of the first curved surface on the second curved surface such that the first resistance force continuously increases and then continuously decreases when the cartridge support unit moves in the mounting direction.

15. The image forming apparatus as claimed in claim 14, wherein the first applying portion comprises a resilient member.

16. The image forming apparatus as claimed in claim 15, wherein the resilient member is a torsion coil spring.

17. The image forming apparatus as claimed in claim 14, wherein the first applying portion is disposed at the cartridge support unit and the abutment portion is disposed at the main casing, the first applying portion being configured to be resiliently deformed by abutting on the abutment portion.

18. The image forming apparatus as claimed in claim 14, wherein the first applying portion is configured to be resiliently deformed when the first applying portion abuts on the abutment portion to move past the abutment portion.

19. The image forming apparatus as claimed in claim 18, wherein the first applying portion is configured to be resiliently deformed and to retract upward by abutting on the abutment portion.

* * * * *